US005444896A

United States Patent [19]

Bourget

[11] Patent Number: 5,444,896

[45] Date of Patent: Aug. 29, 1995

[54] MOLDED METAL TIP FOR LEATHER BELT

[75] Inventor: John Bourget, Southington, Conn.

[73] Assignee: Waterbury Style, Inc., Newington, Conn.

[21] Appl. No.: 173,684

[22] Filed: Dec. 23, 1993

[51] Int. Cl.[6] ..... A44B 1/04

[52] U.S. Cl. ..... 24/265 A; 24/163 R; 24/168; 24/265 WS; 2/336; 2/338; 29/432

[58] Field of Search ..... 2/336, 338, 312; 24/163, 168, 265 WS, 265 R, 265 A; 29/432, 432.1, 432.2; 223/49, 50, 105, 99

[56] References Cited

U.S. PATENT DOCUMENTS

| | | | |
|---|---|---|---|
| 337,997 | 3/1886 | Seymour | 24/265 A |
| 375,380 | 12/1887 | Pollock | 24/265 A |
| 445,491 | 1/1891 | Biesen | 24/265 A |
| 1,027,080 | 5/1912 | Siff | 2/336 |
| 1,379,966 | 5/1921 | Cook | 2/336 |
| 1,454,783 | 5/1923 | Yetter | 24/265 A |
| 2,115,363 | 4/1938 | Gency | 24/265 A |
| 2,140,333 | 12/1938 | Reiter | 24/265 A |
| 2,267,585 | 12/1941 | Churchill | 24/265 A |
| 2,685,114 | 8/1954 | Reiter | 24/265 A |
| 3,346,930 | 10/1967 | Browning | 24/265 A |

*Primary Examiner*—Clifford D. Crowder
*Assistant Examiner*—Gloria Hall
*Attorney, Agent, or Firm*—McCormick, Paulding & Huber

[57] ABSTRACT

A molded metal member has an opening to receive the end of a leather belt. The front face may be embossed or engraved decoratively, and the rear face is formed with a V-shaped slot oriented to achieve a locking action with the leather belt when upset inwardly at assembly with the belt.

6 Claims, 1 Drawing Sheet

MOLDED METAL TIP FOR LEATHER BELT

The present invention relates generally to providing decorative metal tips on leather belts, and deals more particularly with an improved means for assembling a metal tip to a belt.

The prior art teaches that metal tips can be fastened to leather belts by means of conventional fasteners such as threaded screws or the like. This prior art approach is, however, very labor intensive, and the main purpose of the present invention is provide a more economical attachment of decorative metal tips to the ends of leather belts.

In accordance with the present invention a metal tip is molded from a material suitable for electroplating, or suitable for defining decorative embossed artwork on the front face of the metal tip. The molded metal tip has an opening to receive the end of the belt, and the rear wall opposite the decorated front wall portion is adapted to overlie the rear face of the belt in a conventional fashion. However, the rear wall is provided with slot means, preferably in the form of intersecting slots that cooperate to define a generally triangular tab. This tab can be upset when the belt tip is assembled with the leather belt. Prior to being so assembled the molded metal tip may be electroplated or engraved or otherwise improved upon from its initial molded configuration.

It is a further feature of the present invention that these slots are provided to a depth in the rear wall portion of the metal tip such that the slots do not extend entirely through the overall thickness of this rear wall. The slot depth is chosen so that when the tab is upset at assembly a residue of flashing material will be left, secured at least to some extent to the side of the slot, that moves inwardly with the tab. This irregular flashing aids in securing the tab and hence the metal tip to the belt.

A more complete understanding of the invention and its attendant advantages can be had by reference to the accompanying drawings wherein.

Figure 1:
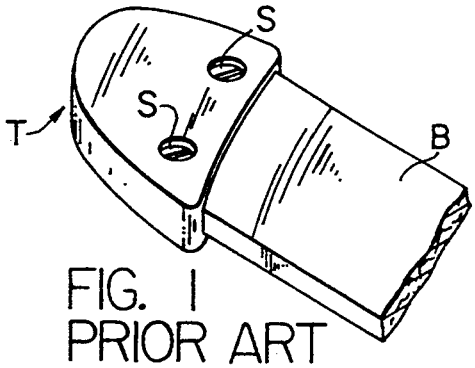
FIG. 1 PRIOR ART
FIG. 1 shows a conventional metal tip secured to a leather belt by screws.

Referring now to the drawings in greater detail, FIG. 1 shows a conventional leather belt fitted with a conventional metal tip T. The tip has an opening for receiving the end of the belt, which belt B is preferably trimmed to conform to the shape of the internal cavity provided for it in the metal tip. In FIG. 1 the rear side of the metal tip T is shown with openings for receiving screws S, S of conventional configuration that must be individually installed to secure the metal tip to the belt.

Figure 2:
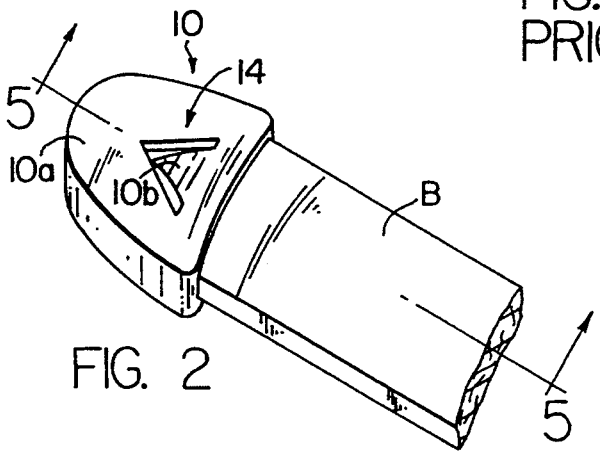
FIG. 2 shows a metal tab constructed in accordance with the present invention, and secured to the leather belt by deforming a tab portion of its rear wall.

FIG. 2 shows a metal tip 10 provided on a leather belt B in accordance with the present invention.

Figure 3:
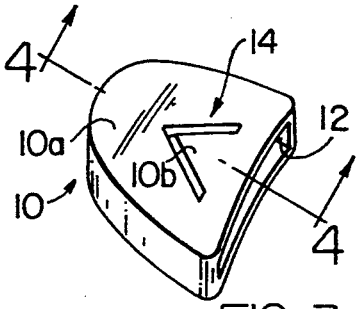
FIG. 3 is a view of the metal tip as cast or molded, and illustrates the flashing provided at the inner end of the slot.

FIG. 3 shows the metal tip 10 as it would be provided from the mold. In FIG. 3 the metal tip can be seen to have an opening or cavity 12 to receive the end of a properly trimmed leather belt, such as described hereinabove with reference to FIGS. 1 and 2 at B. The metal tip 10 has a front wall and a rear wall, the latter being indicated generally at 10*a* in FIG. 3. The front and rear walls overlie the front and rear surfaces of the end of the belt, and it is a feature of the present invention that the rear wall 10*a* is provided with slot means, indicated generally at 14. The slot means is molded into the rear wall of the metal tip 10 and defines a tab portion of that rear wall that can be non-resiliently deformed or upset as suggested in FIG. 2 whereby the said tab portion can be forcibly embedded at least partially, into the leather belt in order to secure the molded metal tip to the end of the leather belt without the need for conventional fasteners or the like.

Preferably and as shown in FIG. 3, the slot means is defined by two intersecting linear slots that define a generally pointed or triangular shape tab 10*b* of said rear wall that can be bent inwardly or deformed as described above so as to be embedded in the leather belt. The V-shaped slot 14 shown in the drawings has the apex of the tab triangle 10*b* so oriented as to provide a secure locking action with the leather belt.

A further feature of the present invention is that the depth of these linear slots is only slightly less than the thickness t of the rear wall itself. This geometry is chosen to define a thin skin or flashing 10*c* at the inner end of the slots during the molding process (see FIG. 4). As a result of this residual skin or flashing material, when the tab portion is upset or deformed this thin skin will rupture in an irregular fashion and thereby achieve a very secure holding action between the metal tab portion and the leather belt.

Figure 4:
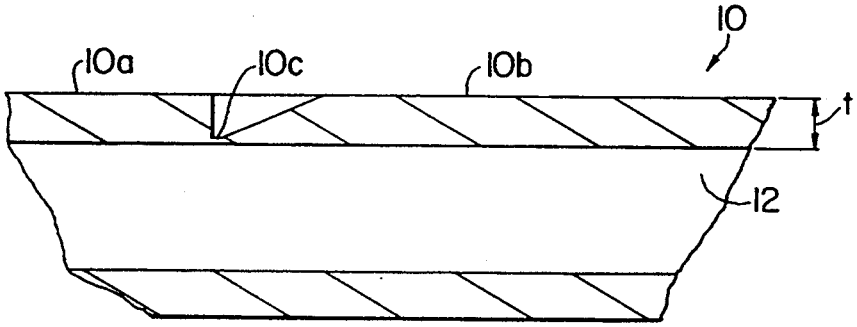
FIG. 4 is a sectional view taken generally on the line 4—4 of FIG. 3.
Figure 5:
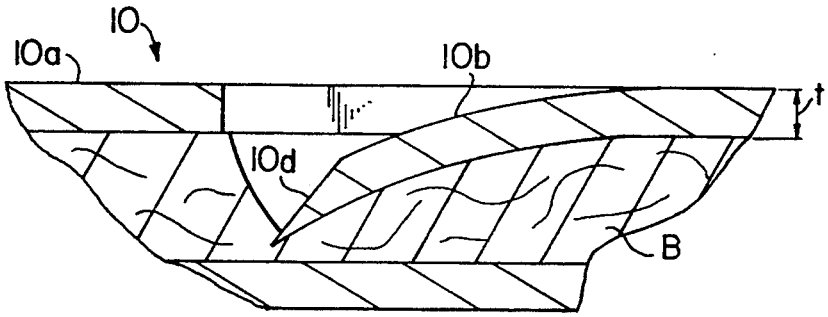
FIG. 5 is a sectional view taken generally on the line 5—5 of FIG. 2.

FIG. 4 illustrates the skin area 10*c* of the slot achieved during the molding process, and FIG. 5 illustrates the effect of rupturing the skin during deformation or upsetting of the tab. Note that the slot has side walls 10*d* that are sloped to further improve the holding action of the tab 10*b*.

The preferred metal for the molded tip member described herein is zinc or the equivalent. Zinc or it's alloys are quite useful in the casting of decorative tips for leather belts.

Silver and its alloys can be used if the belt tip is to be engraved with artistic design work. Alternatively, the molded zinc tip can be electroplated with silver or other precious metals if desired.

I claim:

1. A molded metal tip for a leather belt, said tip comprising a molded metal member having an opening to receive the end of the belt, said molded metal member having front and rear walls adapted to overlie the front and rear surfaces of the belt adjacent the end of the belt, said rear wall having slot means molded therein, said slot means defining a tab portion of said rear wall that can be non-resiliently deformed whereby said tab portion can be embedded into the leather belt to secure said molded metal tip to the end of the leather belt, said slot means having a depth slightly less than the thickness of said rear wall to define a thin skin or flash for said slot means whereby deforming said tab portion of said rear wall at assembly of the metal tip with a leather belt causes said thin skin or flash to rupture and thereby achieve a secure holding action between said deformed tab portion and the belt.

2. The molded metal tip of claim 1 wherein said slot means is defined by two intersecting slots and wherein said rear wall tab portion is characterized by a generally pointed end as a result of said intersecting slots.

3. The molded metal tip of claim 2 wherein said intersecting slots are of uniform linear configuration to define a triangular shape for said tab portion of said rear wall.

4. The molded metal tip of claim 3 wherein said tip is molded from zinc or other readily electroplatable material.

5. The molded metal tip of claim 3 wherein said tip is molded from silver or other readily engravable material.

6. The molded metal tip of claim 3 wherein said tab portion is defined by said intersecting slots to have sloping edge portions that cooperate to define a sharp point at the apex of said triangular tab portion.

* * * * *